US008261383B2

(12) United States Patent
Merino Rodriguez et al.

(10) Patent No.: US 8,261,383 B2
(45) Date of Patent: Sep. 11, 2012

(54) DEVICE FOR RESCUE FROM THE INTERIOR OF A CONFINED SPACE THROUGH A MANHOLE, METHOD OF UTILIZATION THEREOF AND USES

(75) Inventors: Alberto Merino Rodriguez, Getafe Madrid (ES); Pedro Moreno Martín, Getafe Madrid (ES)

(73) Assignee: Airbus Operations, S.L., Getafe (Madrid) (ES)

( * ) Notice: Subject to any disclaimer, the term of this patent is extended or adjusted under 35 U.S.C. 154(b) by 1065 days.

(21) Appl. No.: 12/222,565

(22) Filed: Aug. 12, 2008

(65) Prior Publication Data

US 2009/0193588 A1 Aug. 6, 2009

(30) Foreign Application Priority Data

Jan. 31, 2008 (ES) ..... 200800259

(51) Int. Cl.
*A61G 1/00* (2006.01)

(52) U.S. Cl. ..... 5/628; 5/625

(58) Field of Classification Search ..... 5/625–630
See application file for complete search history.

(56) References Cited

U.S. PATENT DOCUMENTS

| | | | | |
|---|---|---|---|---|
| 2,417,378 | A * | 3/1947 | Robinson | 5/627 |
| 2,788,530 | A | 4/1957 | Ferguson et al. | |
| 3,104,116 | A | 9/1963 | Knight et al. | |
| 3,648,305 | A | 3/1972 | Ersek et al. | |
| 3,811,139 | A | 5/1974 | Shaw et al. | |
| 3,890,659 | A | 6/1975 | Staubs et al. | |
| 5,179,746 | A | 1/1993 | Rogers et al. | |
| 5,201,089 | A * | 4/1993 | Ferreira | 5/627 |
| 5,292,302 | A | 3/1994 | Gianferante et al. | |
| 5,306,026 | A | 4/1994 | Jesse et al. | |
| 5,745,938 | A | 5/1998 | Bartley et al. | |

FOREIGN PATENT DOCUMENTS

| | | |
|---|---|---|
| GB | 2 175 216 | 11/1986 |
| HU | 183556 | 5/1984 |
| WO | 97/30673 | 8/1997 |

OTHER PUBLICATIONS

Office Action issued Mar. 31, 2009 in a counterpart Spanish application (with partial English translation).

* cited by examiner

*Primary Examiner* — Fredrick Conley
(74) *Attorney, Agent, or Firm* — Wenderoth, Lind & Ponack, LLP.

(57) ABSTRACT

A device for rescue from the interior of a confined space via a manhole which includes at least a tray, a prying structure and two elements for tightening of a person to the tray and the prying structure respectively. The tray is elongated and includes on one of its sides at least two means of coupling where the prying structure is inserted; the other side being smooth. Also defined is a method of utilization of said device.

26 Claims, 5 Drawing Sheets

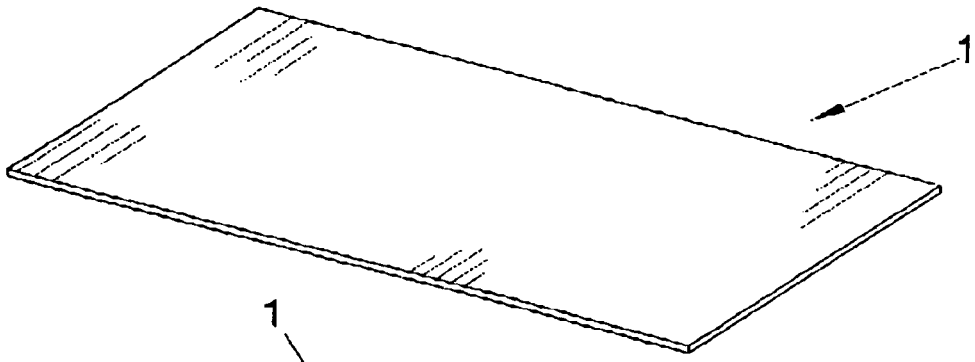
FIG. 1.1
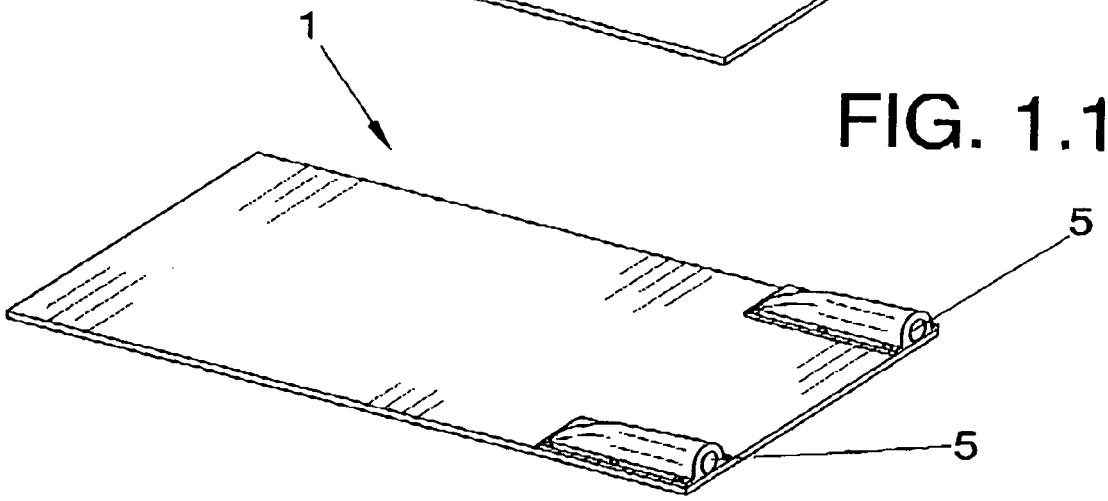
FIG. 1.2
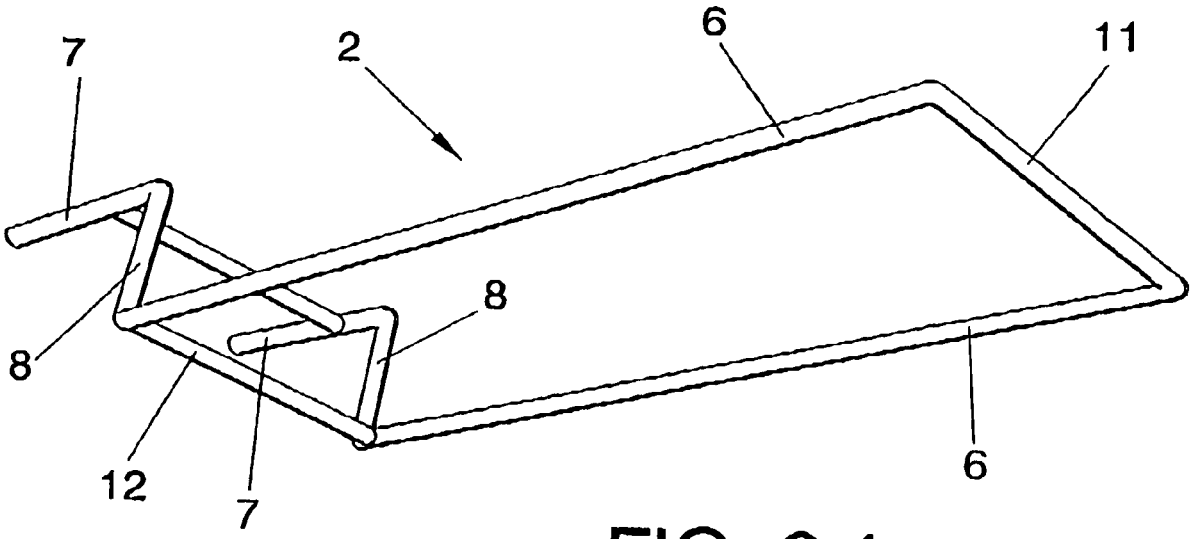
FIG. 2.1

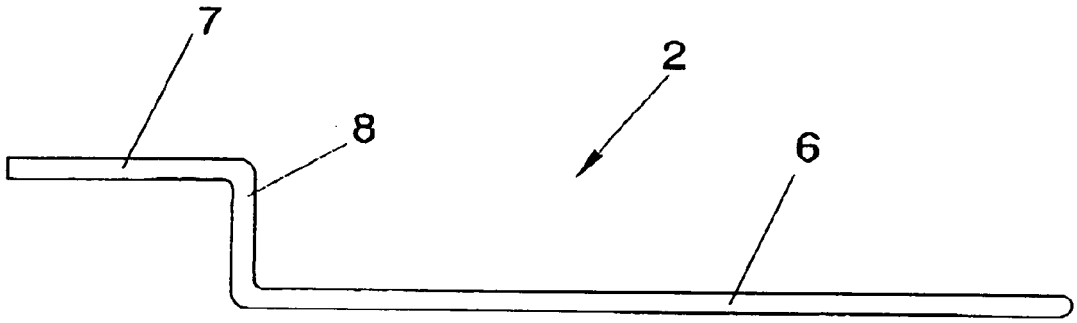
FIG. 2.2
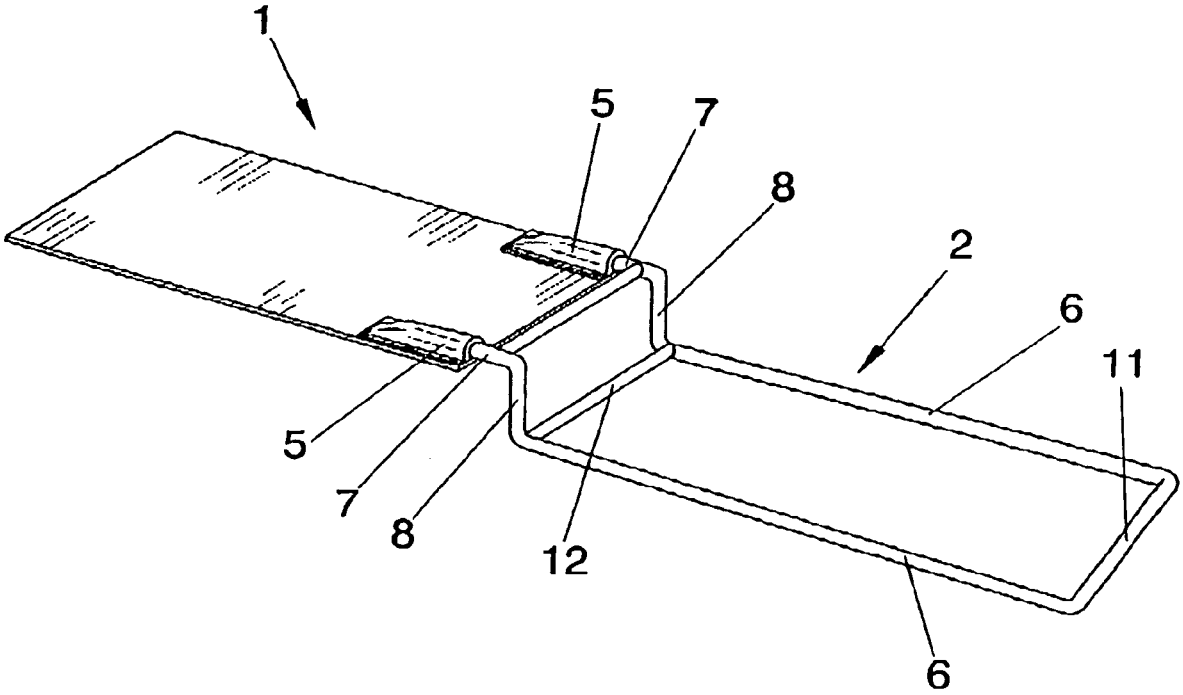
FIG. 3.1

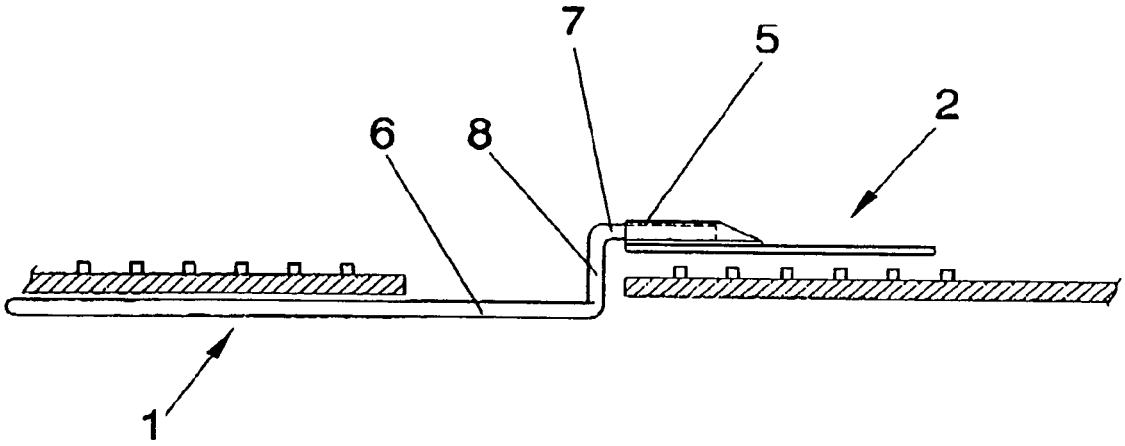
FIG. 7.1
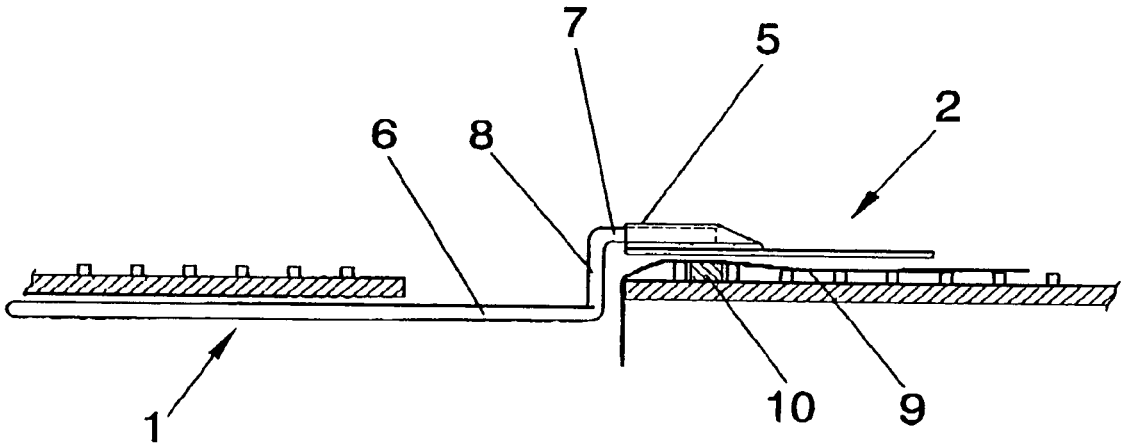
FIG. 7.2

DEVICE FOR RESCUE FROM THE INTERIOR OF A CONFINED SPACE THROUGH A MANHOLE, METHOD OF UTILIZATION THEREOF AND USES

OBJECT OF THE INVENTION

As stated in the title of this specification, the present invention relates to providing a device for rescue of a worker performing tasks in a confined space that is small in terms of its access hole and its height where it is not feasible to carry out the normal rescue of the worker, and a method of utilization of said device.

TECHNICAL FIELD OF THE INVENTION

The present invention comes within the field of devices for rescue from the interior of confined spaces that are of small size in terms of their access hole and height, and the methods of utilization of said device. This invention therefore has application in any sector of the industry where a worker is required to perform any operation inside a confined space with small access hole and height, specially those where the access hole permits the passage of just one person at a time.

Specifically, it has application in the aviation industry, and in particular this invention has been conceived for its application in the rescue of a worker performing tasks inside the wings or the horizontal stabilizer of an aircraft, particularly inside the fuel tanks therein.

Another possible application of the present invention relates to the air conditioning industry, specifically its application for the rescue of workers performing tasks inside air conditioning pipes or ducts where the conditions stated above are to be found.

In short, the applicability conditions of this invention depend on the height of the confined space and the size of its access hole, and so it is applicable in confined spaces where:

a) the HEIGHT of the confined space is such that it allows sufficient elevation of the hips in order to permit extraction, as will be seen further below,
b) but that HEIGHT is in turn not enough to allow a second person to be able to withdraw the worker without the need for other means, and
c) the access opening or hole must be sufficiently narrow so that the person cannot be withdrawn using a traditional method of rescue without damaging the knees or back.

Examples of application: cases of loss of consciousness, or also in cases of people who are conscious who, for any reason such as might be an attack of panic, are unable to get out of the confined space by themselves.

STATE OF THE ART PRIOR TO THE INVENTION

There are a large number of tasks that need to be performed inside the wings or horizontal stabilizer of an aircraft, particularly those concerning the sealing of the different parts, and for this it is necessary to gain access to the interior of them. But access to the inside of the wings or the horizontal stabilizer has to be done once their construction is completed and for that reason access openings or holes, known as "manholes", are created in the lower surface of the wings and horizontal stabilizer of aircraft. But these holes in turn have a negative influence on the structure of the aircraft and so they have to be made as small as possible. In fact, they are reduced such that just one person at a time can pass through. Moreover, not all the inside of the wings and horizontal stabilizer of aircraft has the same dimensions and there exist some where the worker has to introduce his entire body in order to be able to carry out his tasks.

The drawback entailed by this reduction in size of the manholes arises when it comes to having to carry out the rescue of a worker from the inside when he/she is laid down, on account of the possibility of injuring his knees or back, depending on whether he/she is face up or face down. It can be mentioned that for assembly tasks the worker will almost always be face down. Nevertheless, in repair or maintenance works the worker could be face up. In any case, if he/she has not received an injury, there would be no objection to turning him round easily in order to bring him to the face down position.

Moreover, breaking the wings or the horizontal stabilizer of the aircraft in order to gain access to their inside is very costly, not just in terms of money but also in time, besides the fact that the life of the worker might perhaps be in danger.

A device was therefore desirable that would permit the worker to be extracted from the inside of the wings or the horizontal stabilizer via the manholes without causing him additional injuries and in the shortest time possible.

DESCRIPTION OF THE INVENTION

The present invention considers solving the problems stated above and permits a worker to be rescued rapidly, in just a few minutes, bending the worker via his waist, thereby avoiding additional injuries to the knees or back.

The present invention relates to a device for rescue from the interior of a confined space via manholes. Throughout this specification, manhole will be understood to refer to the access holes to the confined space.

The present invention includes at least one tray, at least one prying structure (based on the lever effect), and at least two tightening elements, the tray being preferably rectangular, where its width is limited by the width of the manhole, and its length has to be such that it can be used in the interval of height percentiles from 5 to 95 of the population for which it is intended, and for people who are taller than the tray it has to reach to above the knees and for the shortest people it must not reach as far as the groin area in order not to prevent bending of the hips. The tray is also made from a light material, capable of absorbing the stress to which it is subject in order to take the weight of the person being rescued. In a particular embodiment, the tray is made of carbon fiber. The tray furthermore includes on one of its sides at least two means of coupling, preferably metallic, where it is possible to insert said prying structure, with its other side being preferably smooth.

Moreover, the prying structure can be a solid bar, preferably metallic. The cross-section of the bar is indifferent and it can be circular, octagonal, square, or others.

The construction of the prying structure can, according to its transverse view, be defined as having the form of a step, where the longer end has at least the same length as the tray plus the length of the shorter ends of the prying structure once they have been inserted in the means of coupling, and the height of that step, in other words the vertical segment, is such that permits the long part of the prying structure to remain outside of the confined space from where the rescue is going to take place, when the short part is inserted in the tray and the tray is located beneath the person to rescue, as will be explained further below.

In addition, the construction of the prying structure can be defined according to its view in perspective, as being in the form of a rectangle with at least two projections, the longer sides of the rectangle being equivalent to the longer end in its transverse view, and the two projecting ends being equivalent to the shorter ends in its transverse view, and the shorter ends of the rectangle being those that are going to be used for gripping the structure when the prying structure is operated, as will be explained further below.

For a secure functioning of the device, as will be explained further below in the description of the method of utilization of the rescue device, the tightening elements are used for securing the person to the tray and to the prying structure. These tightening elements can preferably be straps or belts that can be made of any material, for example, leather or nylon, capable of absorbing the stress of securing a person. In the preferred embodiment the tightening elements have been carried out in reinforced nylon, with Velcro at both ends in order to ensure speed and efficiency in fastening the securing.

In an additional embodiment, the tightening elements can be secured to the tray and to the prying structure respectively.

In an additional embodiment, the device for rescue via manholes furthermore includes a blanket, preferably of Teflon, which incorporates a block. The length of the blanket has to be such that it covers a person. The block is intended to overcome the height of any possible ribs present in the floor of the confined space, more precisely the rib of, or ribs closest to, the manhole. The block is nailed, screwed or attached to the blanket, at a distance such that on the one hand it permits the Teflon blanket to exit via the manhole and on the other hand it permits the blanket to cover the surface remaining below the trunk and head of the person to rescue.

The block can preferably be constructed in polyurethane foam, in plastic or in wood.

Moreover, the present invention describes a method of utilization of the rescue device described above, which consists of:

- confirming that the person to rescue is face down, and if not proceeding to position him so that he/she is face down. As stated above, this is possible provided that the person to rescue has not suffered any injury. Nevertheless, it is reminded that in the preferred embodiment considered in this invention (application to the rescue of a worker from the inside of the wings or the horizontal stabilizer of an aircraft), the type of work done there is usually carried out face down;
- locating the tray beneath the legs of the person to rescue so as to leave the smooth side facing the floor, and the side with the means of coupling facing the legs of the person to rescue;
- locating one of the tightening elements so that the ankles of the person are secured to the tray;
- inserting the prying structure, via its two shorter ends when seen in its transverse view, in other words the two projecting ends in their perspective view, in the means of coupling of the tray, leaving the vertical segment and the two longer ends face downwards and outside of the confined space;
- locating the second tightening element so that the feet of the person to rescue are secured to the vertical segment of the prying structure;
- using one hand to secure the prying structure from one of the shorter sides of the rectangle in its perspective view and with the other hand securing the other shorter side of the rectangle and exerting a downwards pressure so that, based on the lever effect, the shorter end is made to rise up together with the tray and with the legs of the person to rescue. The person to rescue will be bent via his waist, thereby preventing any injury to the knees of the worker;
- exerting pressure until the person starts to slide under his own weight, with just the legs of the person being withdrawn in a first stage;
- removing the tightening elements;
- removing the prying structure; and
- allowing the person to slide downwards until he/she exits completely, then removing the tray.

In addition, in the event that the access hole to the interior of the confined space incorporates a flange, the possibility is considered of locating a blanket along with the tray, and beneath it, this blanket being preferably made of Teflon as mentioned earlier, with the block towards the floor, in such a way that it acts as a stop against the said interior flange of the access hole to the place where the person to be rescued is to be found, permitting this obstacle to be easily overcome when the lever effect is exerted in order to evacuate the worker.

So, a rescue is thus achieved in two stages, the first by horizontally displacing the person to rescue and the second by displacing him vertically, though at all times keeping his back and knees in the straight position, thereby avoiding possible additional injuries.

A specific description is made of an application of the device described above and its method of application to the rescue of a worker from the inside of the wings or the horizontal stabilizer of an aircraft.

BRIEF DESCRIPTION OF THE FIGURES

The present invention will be entirely understood on the basis of the brief description given below and the accompanying drawings that are presented, solely by way of example and which are therefore not restrictive within the present invention and in which:

FIGS. 1.1 and 1.2 represent the tray on its smooth faces and with the means of coupling respectively, FIG. 2.1 shows a perspective view of the prying structure, FIG. 2.2 shows a transverse view of the prying structure, FIG. 3.1 shows a perspective view of the prying structure inserted in the tray.

REFERENCES

Figure 4:
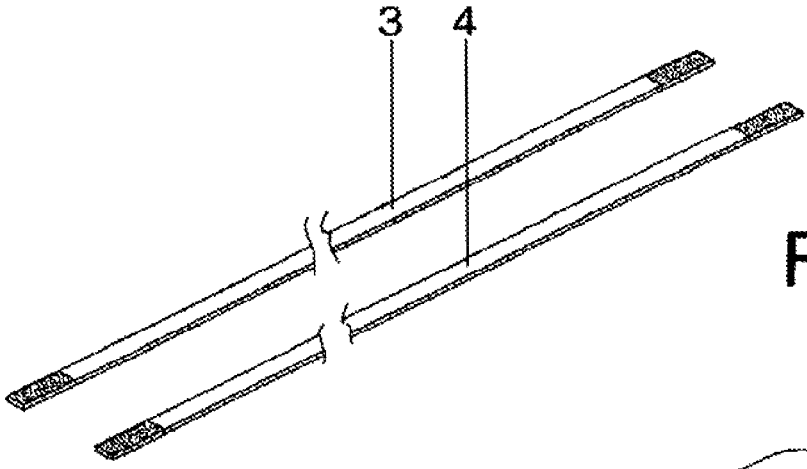
FIG. 4 shows a perspective view of the tightening elements.

1: tray
2: prying structure
3 and 4: tightening elements
5: means of coupling
6: longer end of the prying structure in transverse view (also longer sides of the rectangle in perspective view)
7: shorter end of the prying structure in transverse view (also projecting ends in perspective view)
8: vertical segment of the prying structure in transverse view
9: blanket
10: block

11 and 12: shorter sides of the rectangle in perspective view
13: manholes

FORM OF EMBODIMENT OF THE INVENTION

With the aim of reaching a better understanding of the object and functionality of this patent, and without being understood as restrictive solutions, so FIGS. 1.1 and 1.2 show an arrangement of the tray (1) in perspective, in which it is seen that it can have a preferably rectangular shape, though nevertheless any elongated shape would be acceptable, such that its width is limited by the width of the manhole (13) and its length has to be such that it can be used in the interval of height percentiles from 5 to 95 of the population for which it is intended, and for people who are taller than the tray it has to reach to above the knees and for the shortest people it must not reach as far as the groin area in order not to prevent bending of the hips.

Moreover, on one of its sides the tray includes at least two means of coupling (5), where it is possible to insert said prying structure (2), with its other side being preferably smooth. It can be made of a light material, capable of absorbing the stress to which it will be subjected during the rescue.

In a preferred embodiment, the tray is made of carbon fiber and the means of coupling are metallic.

FIGS. 2.1 and 2.2 show the prying structure (2) in perspective and in its transverse view. It can preferably consist of a solid cylindrical bar, preferably metallic, and its construction can, according to its transverse view (FIG. 2.2), be defined as having the form of a step, where the longer ends (6) have a length at least equal to the length of the tray plus the length of the shorter ends (7) of the prying structure once they have been inserted in the means of coupling (5) and the height of that step (8), in other words the vertical segment (8), is such that permits the long part of the lever to remain outside of the confined space from where the rescue is going to take place (FIGS. 7.1 and 7.2).

In addition, the construction of the prying structure can be defined according to its view in perspective (FIG. 2.1), as being in the form of a rectangle with at least two projections (7), the longer sides of the rectangle (6) being equivalent to the longer end (6) in its transverse view, and the projections (7) being equivalent to the shorter ends (7) in their transverse view, and the shorter ends of the rectangle (11 and 12) being those that are going to be used for gripping the structure when the prying structure is operated, as will be explained further below.

FIG. 3.1 shows a perspective view of the prying structure (2) inserted in the means of coupling (5) of the tray (1).

FIG. 4 shows a perspective view of the tightening elements (3 and 4), which are used for securing the person to the tray and to the prying structure. The means of tightening can preferably be straps or belts that can be made of any material capable of absorbing the stress of securing a person that they are binding. In the preferred embodiment they are made of reinforced nylon, with Velcro at both ends in order to ensure speed and efficiency in that securing.

Likewise, in an additional embodiment, the tightening elements can be previously secured to the tray and to the prying structure respectively.

Figure 5:
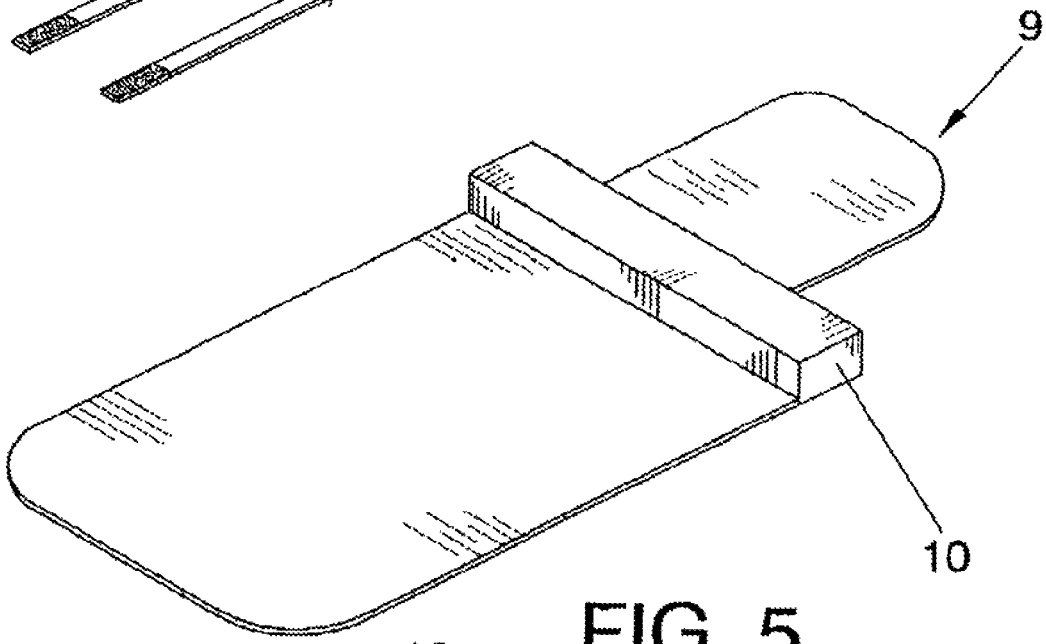
FIG. 5 represents the blanket seen from its side with the block.

FIG. 5 shows a perspective view, seen from below, of the blanket (9), present in an additional embodiment of the invention when the access hole to the confined space includes a flange or ribs. It can be mentioned that the form of the blanket So, the rescue device in confined spaces can furthermore include a blanket (9). The blanket can preferably be made of Teflon and incorporates a block (10). The length of the blanket has to be such that it covers a person. The block is used to overcome the height of any possible ribs present in the floor of the confined space, more precisely the ribs or flanges present in the manhole (13). The block can be nailed, screwed or attached to the blanket, at a distance such that on the one hand it permits the blanket to exit via the manhole (13) and on the other hand it permits the blanket to cover the surface remaining below the trunk and head of the person to rescue. The block can preferably be constructed in polyurethane foam, in plastic or in wood.

Figure 6:
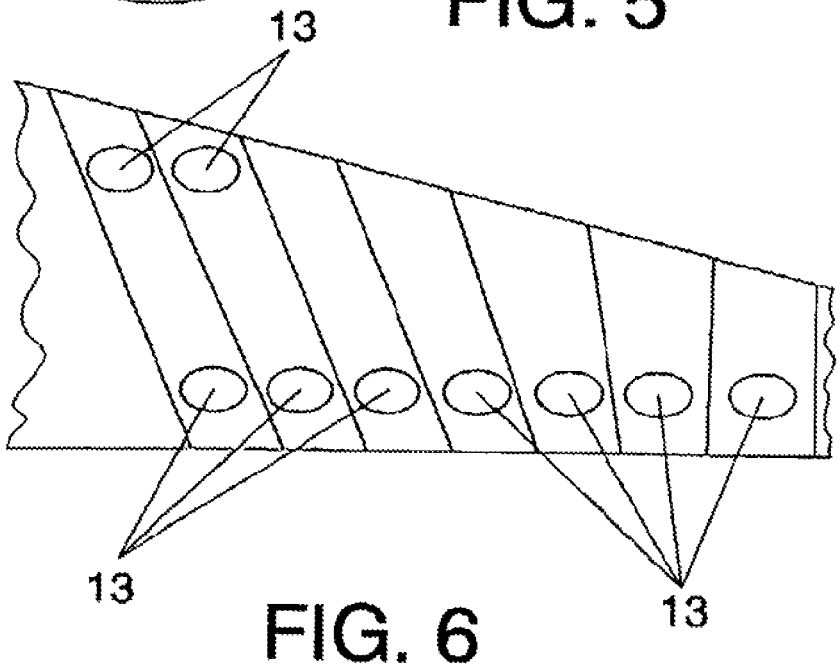
FIG. 6 represents a diagram of how the different manholes are arranged in the wings or horizontal stabilizer of an aircraft, FIGS. 7.1 and 7.2 show a diagram of the rescue device mounted and positioned inside the confined space, without and with the blanket with block, FIGS. 8*a, b* and *c* show a diagrammatic representation of what happens in the interior of a confined space when effecting a rescue using the device described in this invention and its method of utilization, bending the person by his waist and keeping the trunk and legs at all times straight.
Figure 8A:
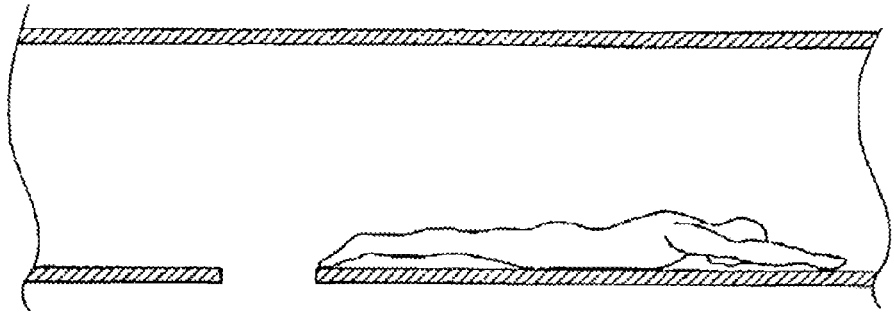
Figure 8B:
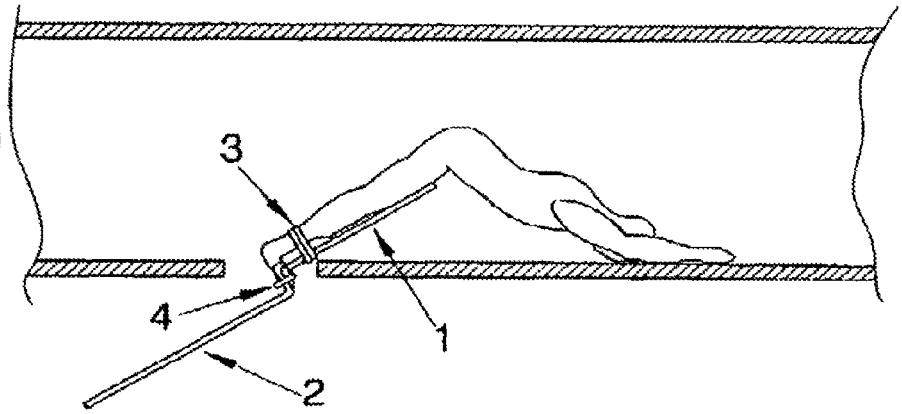
Figure 8C:
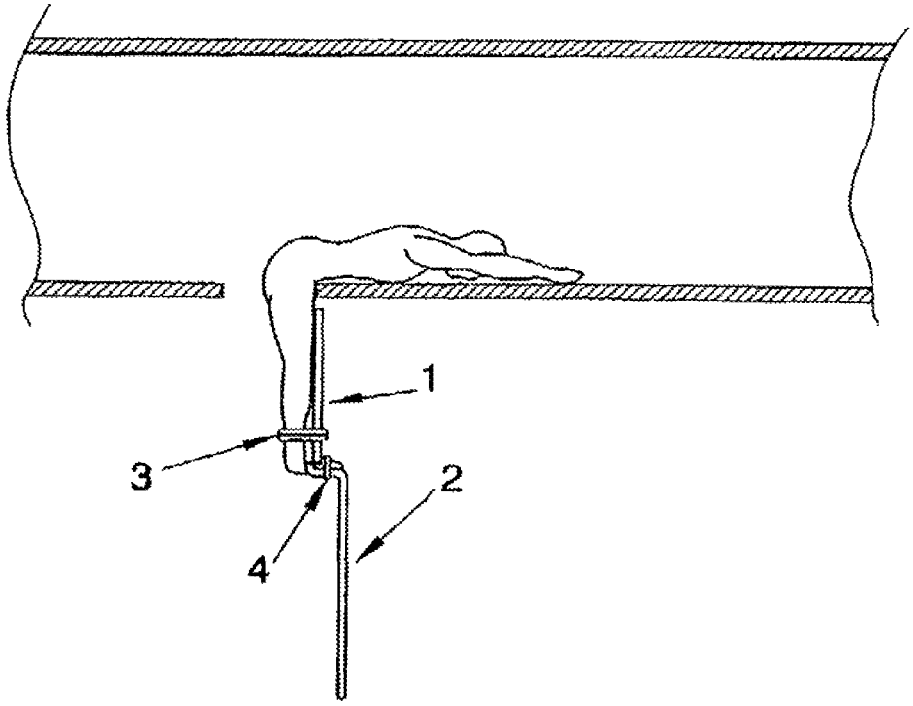

FIG. 6 represents a diagram of how the different manholes (13) are arranged in the wings or horizontal stabilizer of an aircraft.

Moreover, the present invention describes a method of utilization of the rescue device described above, which consists of:

- confirming that the person to rescue is face down, and if not proceeding to position him so that he/she is face down;
- locating the tray (1) beneath the legs of the person to rescue so as to leave the smooth side facing the floor, and the side with the means of coupling (5) facing the legs of the person to rescue;
- locating one of the tightening elements (3 or 4) so that the ankles of the person are secured to the tray (1);
- inserting the prying structure (2), via its two shorter ends (7) when seen in its transverse view, in other words the projections in their perspective view, in the means of coupling (5) of the tray (1), leaving the vertical segment (8) and the two longer ends (6) face downwards and outside of the confined space;
- locating the second tightening element (3 or 4) so that the feet of the person to rescue are secured to the vertical segment (8) of the prying structure (2);
- using one hand to secure the prying structure from one of the shorter sides of the rectangle (11 or 12) in its perspective view and with the other hand securing the other shorter side of the rectangle (11 or 12) and exerting a downwards pressure so that, based on the lever effect, the shorter end (7) is made to rise up together with the tray (1) and with the legs of the person to rescue;
- exerting pressure until the person starts to slide under his own weight, with just the legs of the person being withdrawn in a first stage;
- removing the tightening elements (3 and 4);
- removing the prying structure (2); and
- allowing the person to slide downwards until he/she exits completely, then removing the tray (1).

In the preferred embodiment, the case occurs in which the manhole (13) incorporates a flange or ribs, and so the blanket (9) has to be located along with the tray (1), and beneath it, with the block (10) towards the floor, in such a way that it acts as a stop against the said interior flange of the access hole to the confined space where the person to be rescued is to be found, permitting this obstacle to be easily overcome when the lever effect is exerted in order to evacuate the worker.

The invention claimed is:

1. An extraction device for extraction of a person from inside of a confined space through a manhole (13), comprising:

- a tray (1) to be located inside the confined space and placed beneath lower limbs of the person to be extracted;
- a Z-shaped prying structure (2) including at least one short end (7) fixed to said tray (1) by at least one coupling part (5), at least one long end (6) configured to lever the extraction device, and at least one vertical segment (8) connecting the at least one long end (6) to the at least one short end (7), respectively; and two tightening elements (3, 4) arranged to secure legs of the person to be extracted to the tray (1), and to secure feet of the person to be extracted to the at least one vertical segment (8) of the prying structure (2), respectively.

2. The extraction device for extraction of a person from inside of a confined space through a manhole (13), according to claim 1, wherein the tray (1) has an elongated shape, in such a manner that a width of the tray (1) is less than the manhole (13) and a length of the tray (1) is such that, for tall people, the tray has to reach to above knees and for short people, the tray must not reach as far as a groin area; and the at least one coupling part comprises two coupling parts (5) at one end of the tray (1) where the prying structure (2) is inserted, the other end of the tray (1) being smooth.

3. A method comprising using the device defined in claim 2 for the extraction of a person inside the wings or the horizontal stabilizer of an aircraft.

4. The extraction device for extraction of a person from inside of a confined space through a manhole (13), according to claim 2, wherein the tray (1) is made of a light material, of a strength to absorb stress loaded when taking the weight of the person to be extracted.

5. A method of utilization of the extraction device according to claim 4, for extraction of a person from inside of a confined space through a manhole (13), the method comprising:

a) making sure that the person to be extracted is lying face down;

b) locating the tray (1) beneath the legs of the person to be extracted so as to leave the smooth end of the tray (1) facing a floor, and the other end of the tray (1) having the at least one coupling part (5) facing toward the feet of the person to be extract;

c) locating one of the tightening elements (3,4) so that ankles of the person are secured to the tray (1);

d) inserting the prying structure (2), via the at least one shorter end (7), in the coupling part (5) of the tray (1);

e) locating the second tightening element (3,4) so that the feet of the person to be extracted are secured to the at least one vertical segment (8) of the prying structure (2);

f) applying a downwards pressure to the at least one long end (6) of the prying structure (2) so that, based on a prying effect, the at least one shorter end (7) rises up together with the tray (1) and with the legs of the person to be extracted, while bending the person to be extracted via a waist of the person;

g) maintaining the pressure until the person starts to slide under his own weight, with just the legs of the person being extracted in a first stage;

h) removing the tightening elements (3,4);

i) removing the prying structure (2); and j) allowing the person to slide downwards until the person exits completely, and then removing the tray (1).

6. A method comprising using the device defined in claim 4 for the extraction of a person inside the wings or the horizontal stabilizer of an aircraft.

7. The extraction device for extraction of a person from inside of a confined space through a manhole (13) according to claim 2, wherein the tray (1) is rectangular and made of carbon fiber, and the coupling parts (5) are metallic.

8. A method of utilization of the extraction device according to claim 7, for extraction of a person from inside of a confined space through a manhole (13), the method comprising:

a) making sure that the person to be extracted is lying face down;

b) locating the tray (1) beneath the legs of the person to be extracted so as to leave the smooth end of the tray (1) facing a floor, and the other end of the tray (1) having the at least one coupling part (5) facing toward the feet of the person to be extracted;

c) locating one of the tightening elements (3,4) so that ankles of the person are secured to the tray (1);

d) inserting the prying structure (2), via the at least one shorter end (7), in the coupling part (5) of the tray (1);

e) locating the second tightening element (3,4) so that the feet of the person to be extracted are secured to the at least one vertical segment (8) of the prying structure (2);

f) applying a downwards pressure to the at least one long end (6) of the prying structure so that, based on a prying effect, the at least one shorter end (7) rises up together with the tray (1) and with the legs of the person to be extracted, while bending the person to be extracted via waist of the person;

g) maintaining the pressure until the person starts to slide under his own weight, with just the legs of the person being extracted in a first stage;

h) removing the tightening elements (3,4);

i) removing the prying structure (2); and j) allowing the person to slide downwards until the person exits completely, and then removing the tray (1).

9. A method comprising using the device defined in claim 7 for the extraction of a person inside the wings or the horizontal stabilizer of an aircraft.

10. A method of utilization of the extraction device according to claim 2, for extraction of a person from of a confined space through a manhole (13), the method comprising:

a) making sure that the person to being extracted is lying face down;

b) locating the tray (1) beneath the legs of the person to be extracted so as to leave the smooth end of the tray (1) facing a floor, and the other end of the tray (1) having the at least one coupling part (5) facing toward the feet of the person to be extracted;

c) locating one of the tightening elements (3,4) so that ankles of the person are secured to the tray (1);

d) inserting the prying structure (2), via the at least one shorter end (7), in the coupling part (5) of the tray (1);

e) locating the second tightening element (3,4) so that the feet of the person to be extracted are secured to the at least one vertical segment (8) of the prying structure (2);

f) applying a downwards pressure to the at least one long end (6) of the prying structure (2) so that, based on a prying effect, the at least one shorter end (7) rises up together with the tray (1) and with the legs of the person to be extracted, while bending the person to be extracted via a waist of the person;

g) maintaining the pressure until the person starts to slide under his own weight, with just the legs of the person being extracted in a first stage;

h) removing the tightening elements (3,4);

i) removing the prying structure (2); and j) allowing the person to slide downwards until the person exits completely, and then removing the tray (1).

11. The extraction device for extraction of a person from inside of a confined space through a manhole (13), according to claim 1, wherein the tightening elements (3,4) are straps or belts made of a material having strength to absorb stress of securing the person to be extracted.

12. The extraction device for extraction of a person from inside of a confined space through a manhole (13), according to claim 11, wherein the tightening elements (3,4) are made of reinforced nylon and Velcro.

13. A method of utilization of the extraction device according to claim 12, for extraction of a person from inside a confined space through a manhole (13), the method comprising:

a) making sure that the person to be extracted is lying face down;

b) locating the tray (1) beneath the legs of the person to be extracted so as to leave the smooth end of the tray (1) facing a floor, and the other end of the tray (1) having the at least one coupling part (5) facing toward the feet of the person to be extracted;

c) locating one of the tightening elements (3,4) so that ankles of the person are secured to the tray (1);

d) inserting the prying structure (2), via the at least one shorter end (7), in the coupling part (5) of the tray (1);

e) locating the second tightening element (3,4) so that the feet of the person to be extracted are secured to the at least one vertical segment (8) of the prying structure (2);

f) applying a downwards pressure to the at least one long end (6) of the prying structure (2) so that, based on a prying effect, the at least one shorter end (7) rises up together with the tray (1) and with the legs of the person to be extracted, while bending the person to be extracted via waist of the person;

g) maintaining the pressure until the person starts to slide under his own weight, with just the legs of the person being extracted in a first stage;

h) removing the tightening elements (3,4);

i) removing the prying structure (2); and j) allowing the person to slide downwards until the person exits completely, and then removing the tray (1).

14. A method comprising using the device defined in claim 12 for the extraction of a person inside the wings or the horizontal stabilizer of an aircraft.

15. A method of utilization of the extraction device according to claim 11, for extraction of a person from inside of a confined space through a manhole (13), the method comprising:

a) making sure that the person to be extracted is lying face down;

b) locating the tray (1) beneath the legs of the person to be extracted so as to leave the smooth end of the tray (1) facing a floor, and the other end of the tray (1) having the at least one coupling part (5) facing toward the feet of the person to be extracted;

c) locating one of the tightening elements (3,4)so that ankles of the person are secured to the tray (1);

d) inserting the prying structure (2), via the at least one shorter end (7), in the coupling part (5) of the tray (1);

e) locating the second tightening element (3,4) so that the feet of the person to rescue be extracted are secured to the at least one vertical segment (8) of the prying structure (2);

f) applying a downwards pressure to the at least one long end (6) of the prying structure (2) so that, based on a prying effect, the at least one shorter end (7) rises up together with the tray (1) and with the legs of the person to be extracted, while bending the person to be extracted via waist of the person;

g) maintaining the pressure until the person starts to slide under his own weight, with just the legs of the person being extracted in a first stage;

h) removing the tightening elements (3,4);

i) removing the prying structure (2); and j) allowing the person to slide downwards until the person exits completely, and then removing the tray (1).

16. A method comprising using the device defined in claim 11 for the extraction of a person inside the wings or the horizontal stabilizer of an aircraft.

17. The extraction device for extraction of a person from inside of a confined space through a manhole (13), according to claim 1, further comprising a blanket (9), and a block (10) nailed, screwed or attached to the blanket (9) at a location between opposing ends of the blanket (9) such that the block (10) permits the blanket (9) to exit through the manhole (13) and permits the blanket (9) to cover the surface of a trunk and a head of the person to be extracted.

18. The extraction device for extraction of a person from inside of a confined space through a manhole (13), according to claim 17, wherein the blanket (9) is made of Teflon and the block (10) is made of wood, plastic or polyurethane foam.

19. A method comprising using the device defined in claim 18 for the extraction of a person inside the wings or the horizontal stabilizer of an aircraft.

20. A method of utilization of the extraction device according to claim 18, for extraction of a person from inside of a confined space through a manhole (13), the method comprising:

a) making sure that the person to be extracted is lying face down;

b) locating the tray (1) beneath the legs of the person to be extracted so as to leave the smooth end of the tray (1) facing a floor, and the other end of the tray (1) having the at least one coupling part (5) facing toward the feet of the person to be extracted;

c) locating one of the tightening elements (3,4) so that ankles of the person are secured to the tray (1);

d) inserting the prying structure (2), via the at least one shorter end (7), in the coupling part (5) of the tray (1);

e) locating the second tightening element (3,4) so that the feet of the person to be extracted are secured to the at least one vertical segment (8) of the prying structure (2);

f) applying a downwards pressure to the at least one long end (6) of the prying structure (2) so that, based on a prying effect, the at least one shorter end (7) rises up together with the tray (1) and with the legs of the person to be extracted, while bending the person to be extracted via waist of the person;

g) maintaining the pressure until the person starts to slide under his own weight, with just the legs of the person being extracted in a first stage;

h) removing the tightening elements (3,4);

i) removing the prying structure (2); and j) allowing the person to slide downwards until the person exits completely, and then removing the tray (1).

21. A method of utilization of the extraction device according to claim 17 for extraction of a person from inside of a confined space through a manhole (13) the method comprising:

a) making sure that the person to be extracted is lying face down;

b) locating the tray (1) beneath the legs of the person to be extracted so as to leave the smooth end of the tray (1) facing a floor, and the other end of the tray (1) having the at least one coupling part (5) facing toward the feet of the person to be extracted;

c) locating one of the tightening elements (3,4) so that ankles of the person are secured to the tray (1);

d) inserting the prying structure (2), via the at least one shorter end (7), in the coupling part (5) of the tray (1);

e) locating the second tightening element (3,4) so that the feet of the person to be extracted are secured to the at least one vertical segment (8) of the prying structure (2);

f) applying a downwards pressure to the at least one long end (6) of the prying structure (2) so that, based on a prying effect, the at least one shorter end (7) rises up together with the tray (1) and with the legs of the person to be extracted, while bending the person to be extracted via waist of the person;

g) maintaining the pressure until the person starts to slide under his own weight, with just the legs of the person being extracted in a first stage;

h) removing the tightening elements (3,4);

i) removing the prying structure (2); and j) allowing the person to slide downwards until the person exits completely, and then removing the tray (1).

22. A method comprising using the device defined in claim 17 for the extraction of a person inside the wings or the horizontal stabilizer of an aircraft.

23. A method of utilization of the extraction device according to claim 1 for extraction of a person from inside of a confined space through a manhole (13), the method comprising:

a) making sure that the person to be extracted is lying face down;

b) locating the tray (1) beneath the legs of the person to be extracted so as to leave the smooth end of the tray (1) facing a floor, and the other end of the tray (1) having the at least one coupling part (5) facing toward the feet of the person to be extracted;

c) locating one of the tightening elements (3,4) so that ankles of the person are secured to the tray (1);

d) inserting the prying structure (2), via the at least one shorter end (7), in the coupling part (5) of the tray (1);

e) locating the second tightening element (3,4) so that the feet of the person to be extracted are secured to the at least one vertical segment (8) of the prying structure (2);

f) applying a downwards pressure to the at least one long end (6) of the prying structure (2) so that, based on a prying effect, the at least one shorter end (7) rises up together with the tray (1) and with the legs of the person to be extracted, while bending the person to be extracted via a waist of the person;

g) maintaining the pressure until the person starts to slide under his own weight, with just the legs of the person being extracted in a first stage;

h) removing the tightening elements (3,4);

i) removing the prying structure (2); and j) allowing the person to slide downwards until the person exits completely, and then removing the tray (1).

24. The method of utilization of the device for extraction from inside of a confined space through a manhole (13), according to claim 23, wherein said locating of the tray comprises:

locating, along with the tray (1), and beneath the tray (1), the blanket (9) with the block (10) towards the floor, in such a way that the block (10) acts as a stop against a flange or a rib existing in the inside of the confined space.

25. A method comprising using the device defined in claim 1 for the extraction of a person inside the wings or the horizontal stabilizer of an aircraft.

26. The extraction device for extraction of a person from inside of a confined space through a manhole (13), according to claim 1, wherein the tray (1) is fixed to the at least one short end (7) by the at least one coupling part (5) in such a manner that the tray (1) extends in a first direction away from the at least one vertical segment (8), and said at least one long end (6) is connected to the at least one vertical segment (8) in such a manner that the at least one long end (6) extends in a second direction, opposite the first direction, away from the at least one vertical segment (8).

* * * * *